United States Patent [19]

Ortutay

[11] 3,990,198

[45] Nov. 9, 1976

[54] SYSTEM FOR SEPULCHRAL URN (POST CREMATION) BURIAL

[75] Inventor: Tamas Ortutay, Budapest, Hungary

[73] Assignee: Finomkerámiaipari Müvek, Budapest, Hungary

[22] Filed: Apr. 22, 1975

[21] Appl. No.: 570,471

[30] Foreign Application Priority Data

Apr. 25, 1974 Hungary ..... OU 9

[52] U.S. Cl. ..... 52/136; 27/1; 52/284; 211/71

[51] Int. Cl.[2] ..... E04H 13/00

[58] Field of Search ..... 52/134–138, 52/220, 284; 211/71; 27/1

[56] References Cited

UNITED STATES PATENTS

| | | | |
|---|---|---|---|
| 3,076,293 | 2/1963 | Baudoux | 52/220 |
| 3,254,773 | 6/1966 | Diem | 211/71 |
| 3,529,389 | 9/1970 | Wilkins | 52/284 X |
| 3,600,867 | 8/1971 | Shuey | 52/284 |
| 3,772,826 | 11/1973 | Ferver | 52/137 X |

*Primary Examiner*—J. Karl Bell
*Attorney, Agent, or Firm*—Young & Thompson

[57] ABSTRACT

The subject matter of the invention is a system for sepulchral urn (post cremation) burial.

The system consists of one or more units of building character, where in at least a part of the building elements urn boxes are formed. The building elements are provided on their outer surface with projections and recesses fitting into each other. It is advantageous that the complete unit shall not be necessarily built up at once, but it can be extended according to the current demands. The single urn elements can be produced in aesthetically attractive form, at the same time, however, in mass production.

1 Claim, 20 Drawing Figures

Figure 1A:
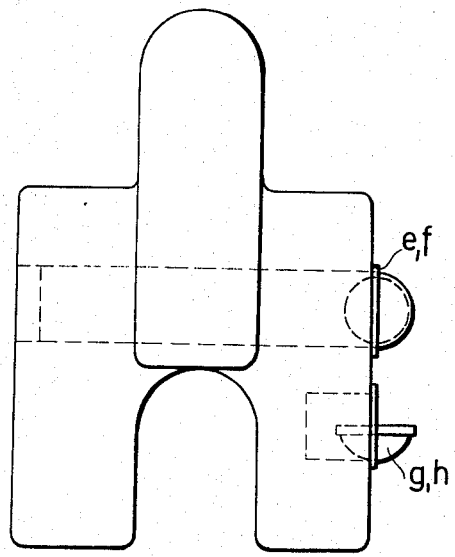

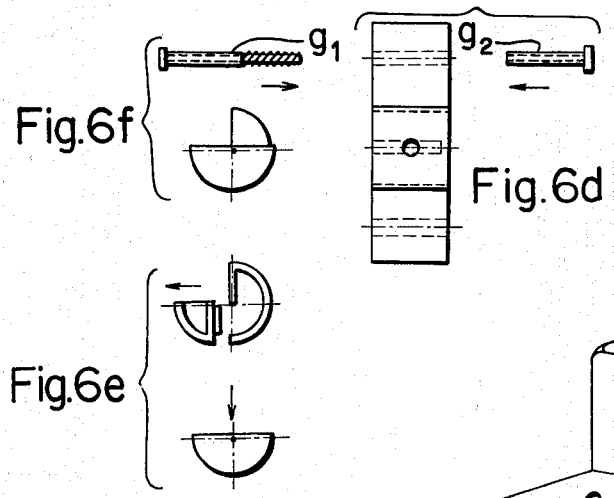
g1
g2
Fig.6f
Fig.6d
Fig.6e
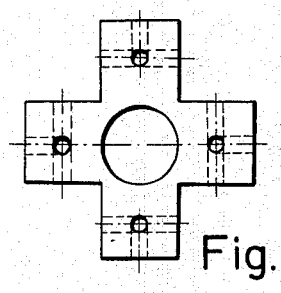
Fig.6c
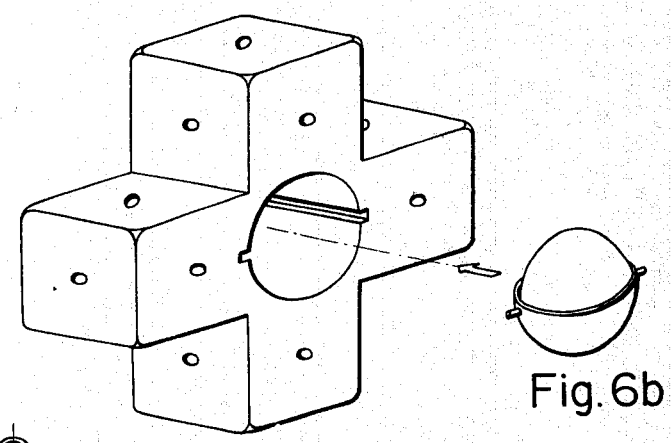
Fig.6b
Fig.6a
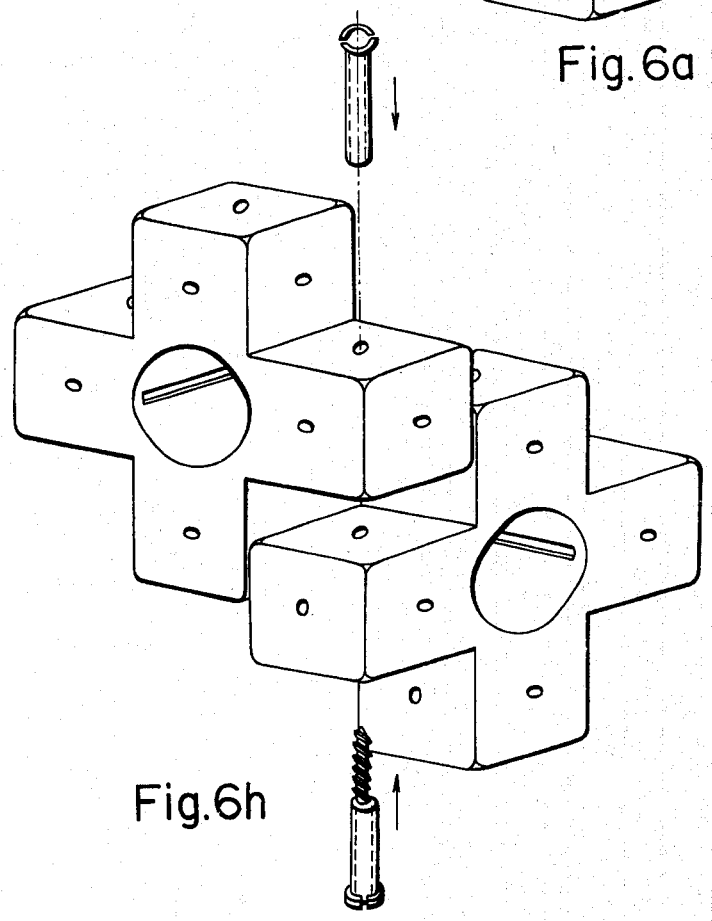
Fig.6h

SYSTEM FOR SEPULCHRAL URN (POST CREMATION) BURIAL

The currently used columbaria are made of artificial stone or concrete, sometimes covered with marble. The urn being emplaced, the urn box is covered with glass, marble or artificial stone plate. This covering is not in formal harmony with the columbarium. The columbarium is often built together with the mortuary, in the wall of which empty holes are left for the urns. This being filled — as e.g. in the graveyard of Farkasret (Budapest) — the limiting wall of the graveyard is a columbarium divided into poor-looking artificial-stone boxes, plastered from behind, provided with sheet iron roof. The countless urn boxes gaping vacantly being built up in advance produce a disagreeable effect. These solutions are very unsatisfactory, even structurally.

Another recent example is the new columbarium in Debrecen, Hungary built up in the vicinity of the old crematorium having a high architectural historical value. As against the inexpensive and ugly solution in the graveyard of Farkasret mentioned above, here has been achieved a similarly bad effect but at high cost. The analysis of the building does not belong to the scope of the present description; it should be, however, mentioned, that the urn boxes gaping in the narrow concrete corridors make a highly unpleasant effect. The fundamental error of both the inexpensive and the lavish solutions is the same: a vast number of urn boxes are built simultaneously but they will be filled only slowly.

Instead of the above mentioned, sometimes tasteless, elsewhere technically primitive solutions, the following solution is provided according to the present invention.

In the new graveyard or graveyard section to be established where new urn holding units are intended to be located, first the space to be progressively occupied by urn holding elements shall be designed — taking into consideration the dimensions and formal possibilities of the space — and at the same time, the special urn box type shall be determined of which the space can be built up. When designing the urn box, the structure of the planned monument should be taken into account and the columbarium should be expediently designed so as to render possible its extension with the fewest possible supplementary elements. Another highly essential point of view consists in that the shape and design of the columbarium and urn boxes shall be in harmony with the burial requirements and customs of the community /arrangement of candles and flowers, inscriptions, symbols, the family members being buried side by side, etc./.

Having completed the design, in the course of time, due to the inevitable expansion of urn holding units, architecturally significant spaces and monuments can be established the construction of which begins with the erection of the first urn holding unit and in the course of use, it increases from generation to generation and cannot be completed but only discontinued.

The essential practical significance of the invention is evident if it is considered, how slowly the new cultural public buildings — e.g. National Theatre, new cultural centres, new marriage rooms, etc. — are constructed, since they required one-time large investments. Perhaps even therefore, it would not be without interest to lay the foundation of a few public buildings which, according to the natural order of life, grow like a snail shell.

In the burial systems described above the development of an information preserving system would be similarly possible. In this case, the urn box would contain not only the urn with the ashes of the deceased but also a small information preserving system, e.g. tape recorder, slides, video recorder, hologram, etc., which preserves the information deemed essential about the deceased at the technical level of the current age. The documents recorded in the lives of outstanding personalities can be played back on the occasion of an eventual commemoration.

If an entirely new graveyard is established, it should be developed on uniform functional and architectural principles, the determinative basic element being the urn contained, the design of which and the regularity of its assembly fundamentally determining the structure and shape of the space to be provided. The subject matter of the invention will be explained by reference to two exemplary embodiments. The invention, however, is not limited to these two solutions, since the basic inventive idea, the burial space made up by assembled urn holding elements can be built up in various manners, using urn containers of different type.

Figure 1B:
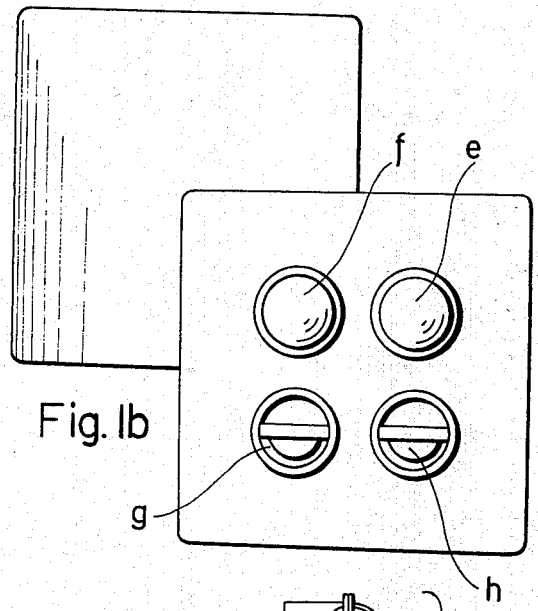
Figure 1D:
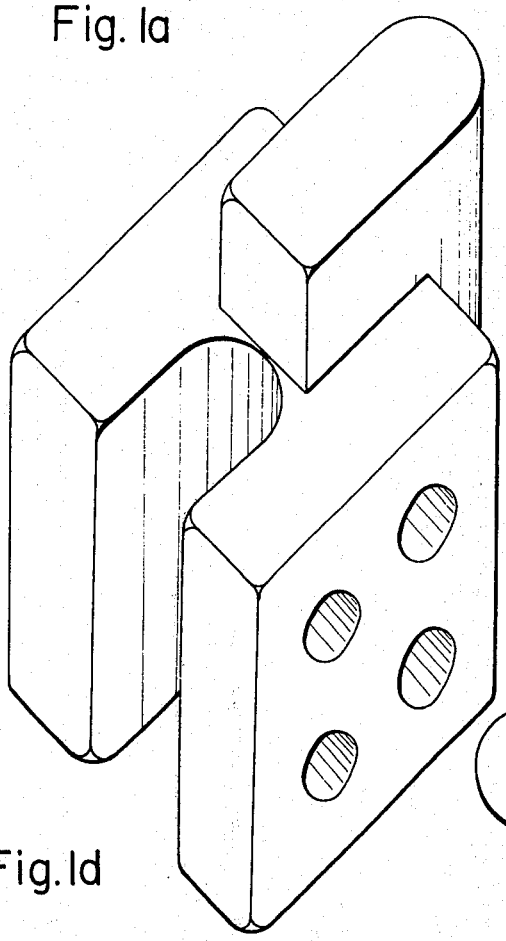
Figure 1C:
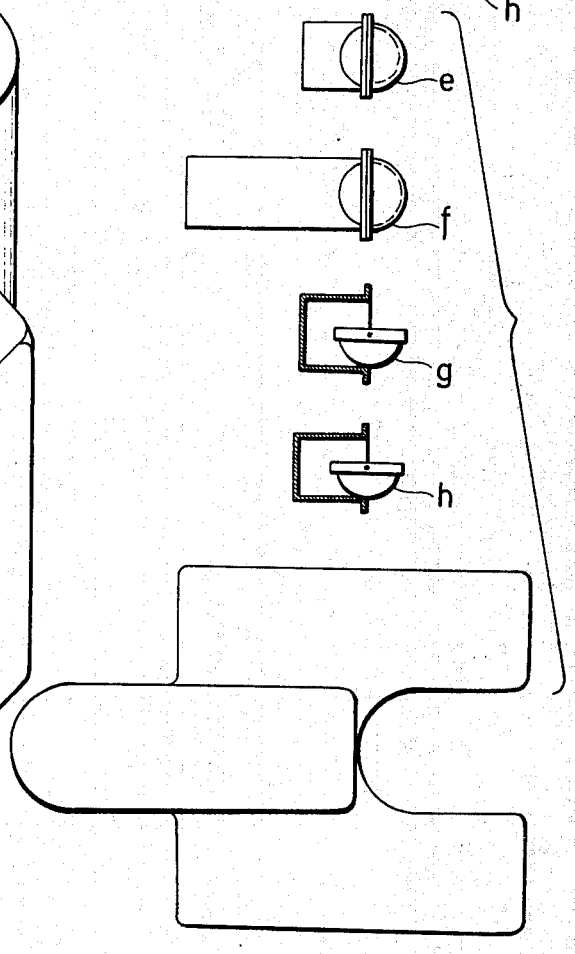

The invention will be further described and illustrated by way of example with reference to the accompanying drawings, in which:

FIG. 1*a* is the plan view of an urn holding element according to the invention;

FIG. 1*b* shows the front elevation of the urn holding element according to FIG. 1*a*, whereas FIG. 1*c* shows the bottom view of the same.

FIG. 1*d* is a top perspective view of the urn holding element according to FIGS. 1*a*, 1*b* and 1*c*.

FIG. 1*e* illustrates as an example a holder arranged in the said urn holding element, wherein the name, information, inscription, etc. can be arranged.

FIG. 1*f* shows an embodiment of the urn; this can be similarly located in the cave of the urn holding element and can be closed e.g. by means of a cover provided with a bayonet mount.

FIGS. 1*g* and 1*h* illustrate the flower stand and candle stand to be located in the urn holding element.

Figure 2:
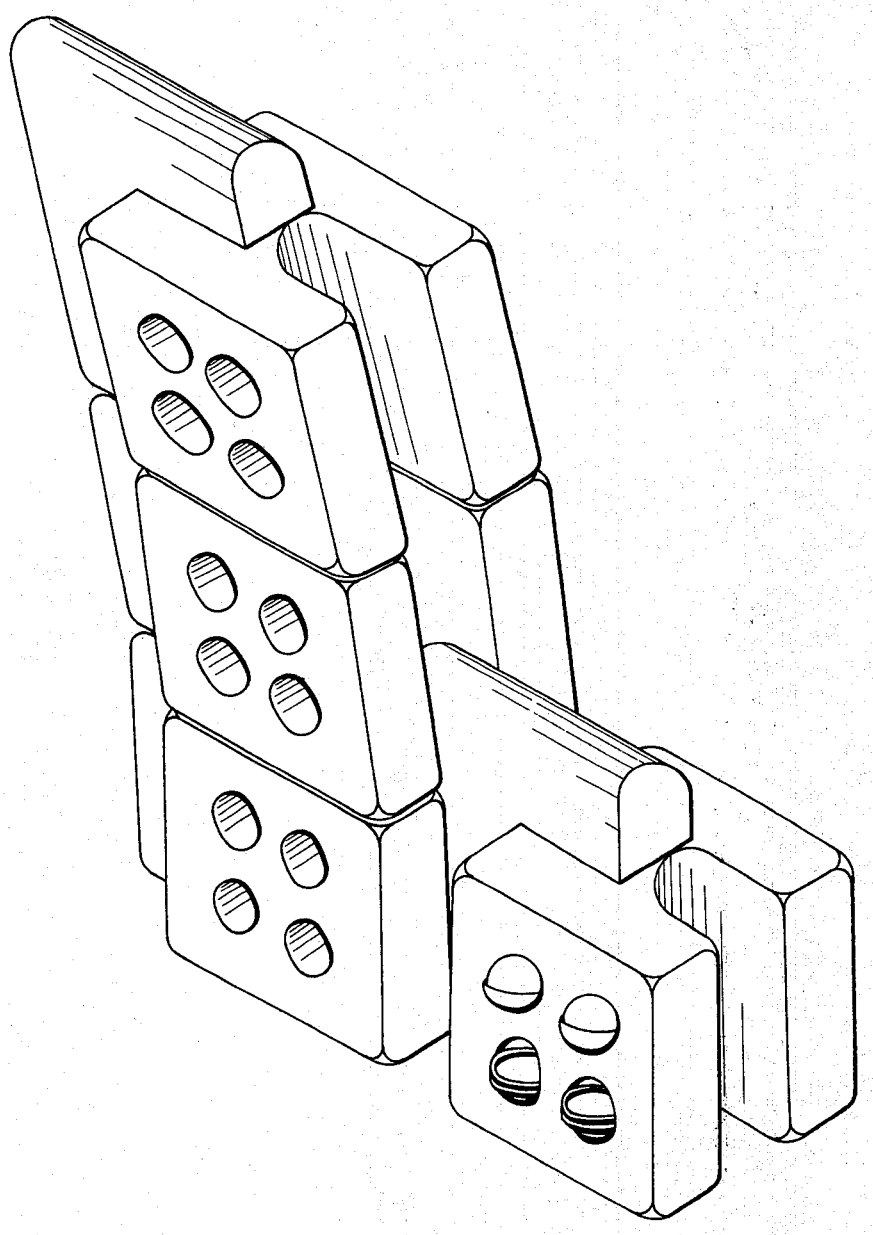

FIG. 2 shows a part of the building to be assembled of urn holding elements shown in FIG. 1.

Figure 3A:
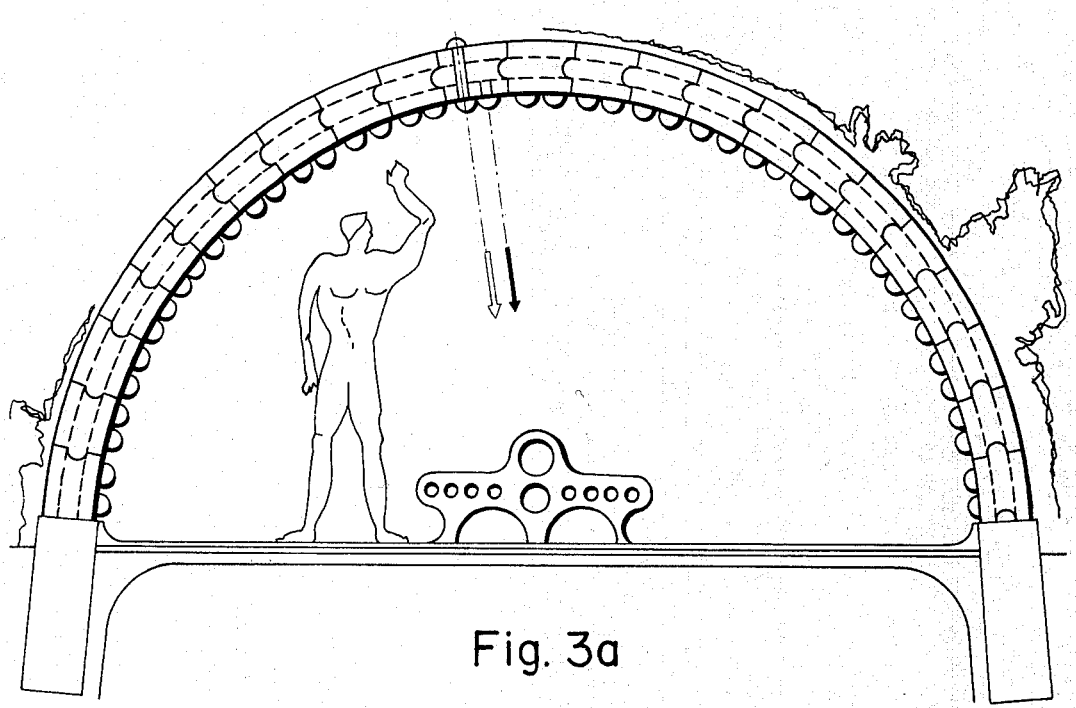
Figure 3B:
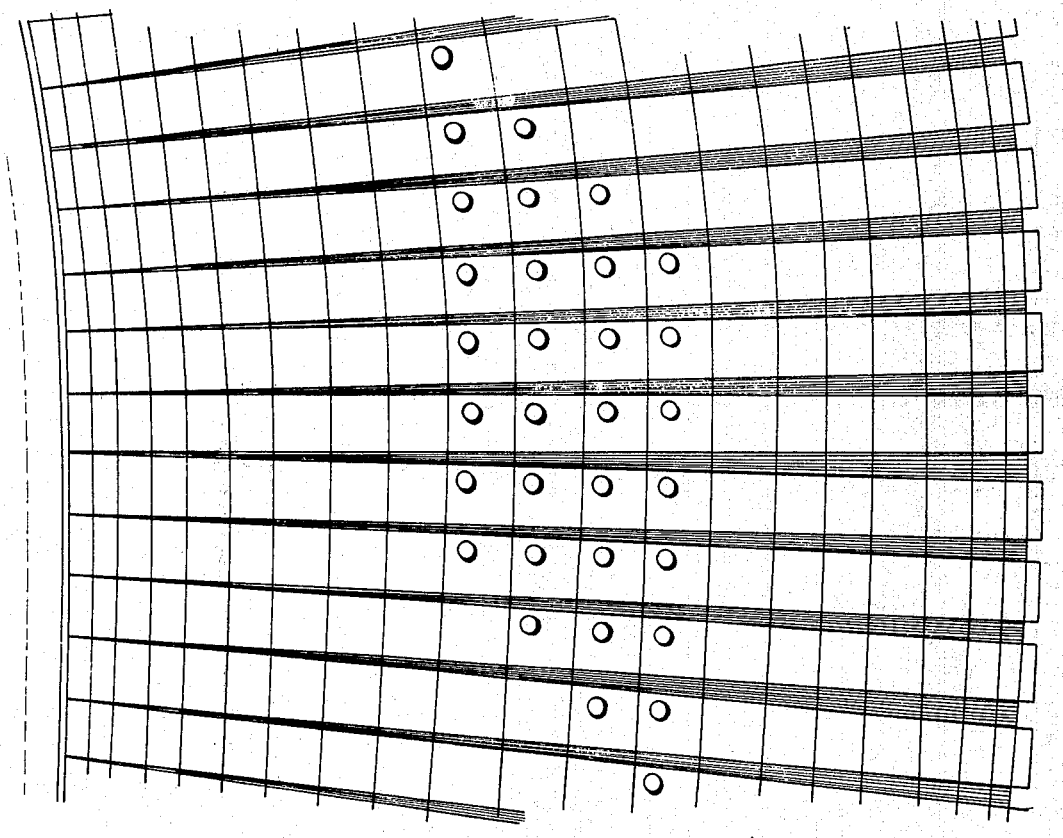

FIGS. 3*a* and 3*b* show the sectional and plan views of a part of a barrel vault assembled of urn holding elements according to FIG. 1.

Figure 4:
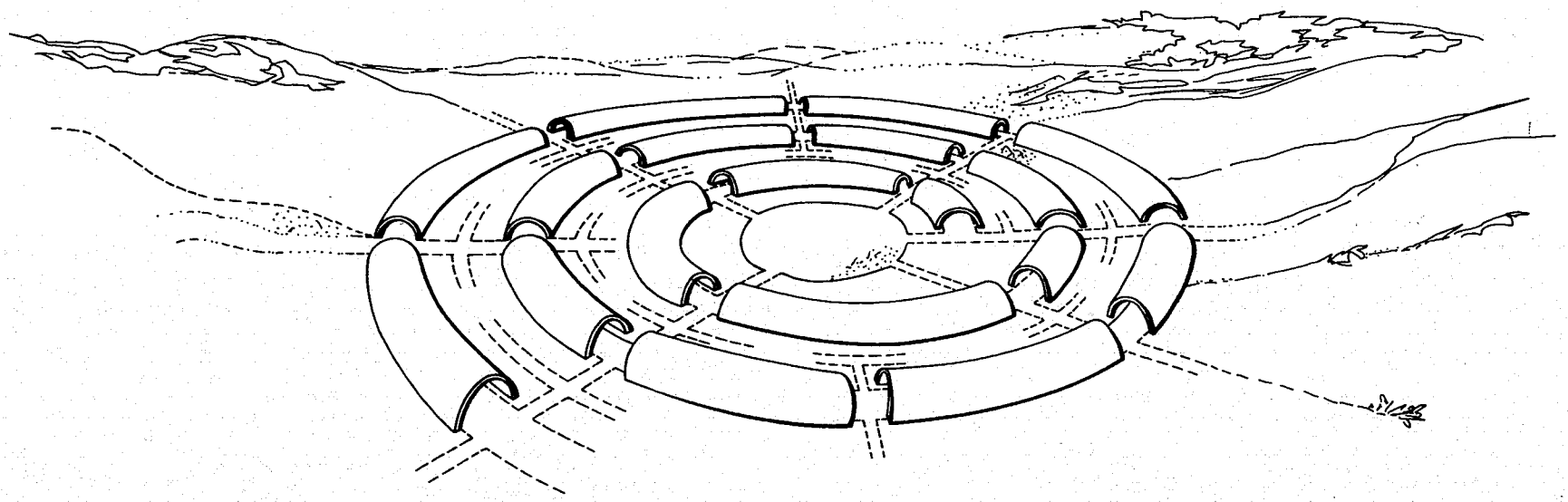

FIG. 4 is a perspective view of the building of barrel vault shape built up in helical form by way of example, and to be further developed.

Figure 5A:
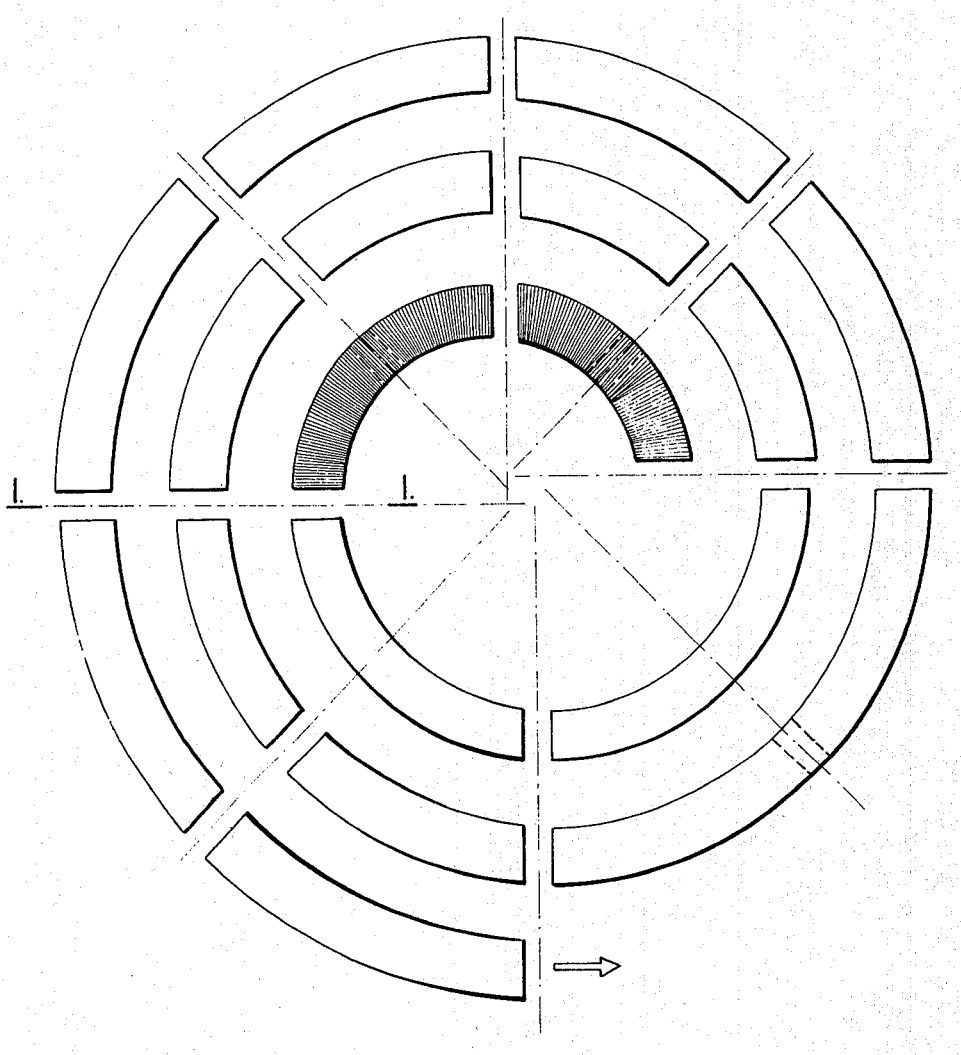
Figure 5B:
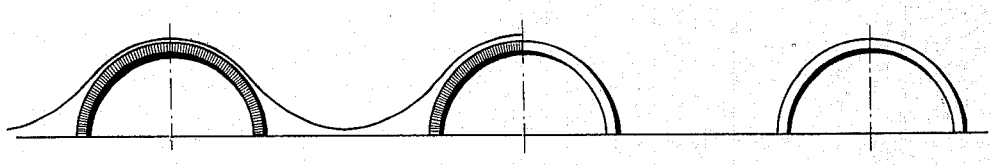

FIG. 5*a* illustrates the plan view of the building according to FIG. 4, whereas FIG. 5*b* is the section taken along the line I-I of FIG. 5*a*.

FIG. 6*a* shows in top perspective another embodiment of the urn holding element.

FIG. 6*b* illustrates an urn of another form, again by way of example, to be arranged in the urn holding element according to FIG. 6*a*.

FIGS. 6*c* and 6*d* show the elevation and the side view, respectively, of the urn holding element according to FIG. 6*a*.

FIG. 6*e* is the sectional view in disassembled state of the urn, flower stand and cover part, whereas FIG. 6*f* shows schematically these parts in assembled form.

FIGS. $6g_1$ and $6g_2$ show the two threaded parts of the screw fastening the urn holding elements, while in FIG. 6*h* an assembly method of the two urn holding elements according to FIG. 6*a* is to be seen, indicating the location of the fastening screw.

Figure 7:
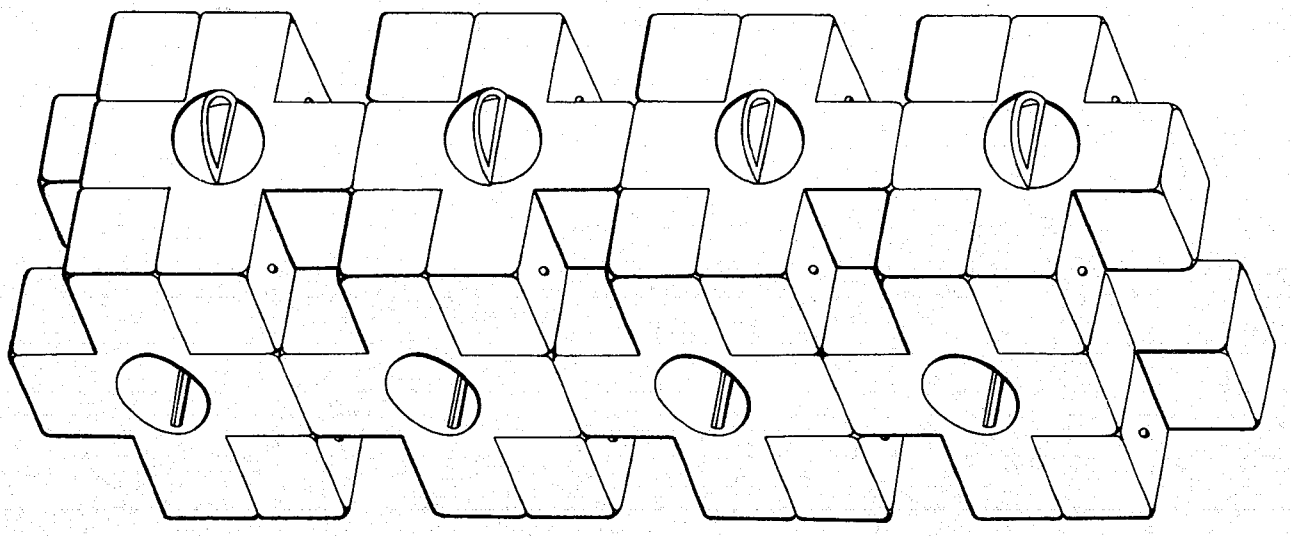

FIG. 7 illustrates a possible assembly scheme of the urn holding elements according to FIG. 6*a*.

Figure 8A:
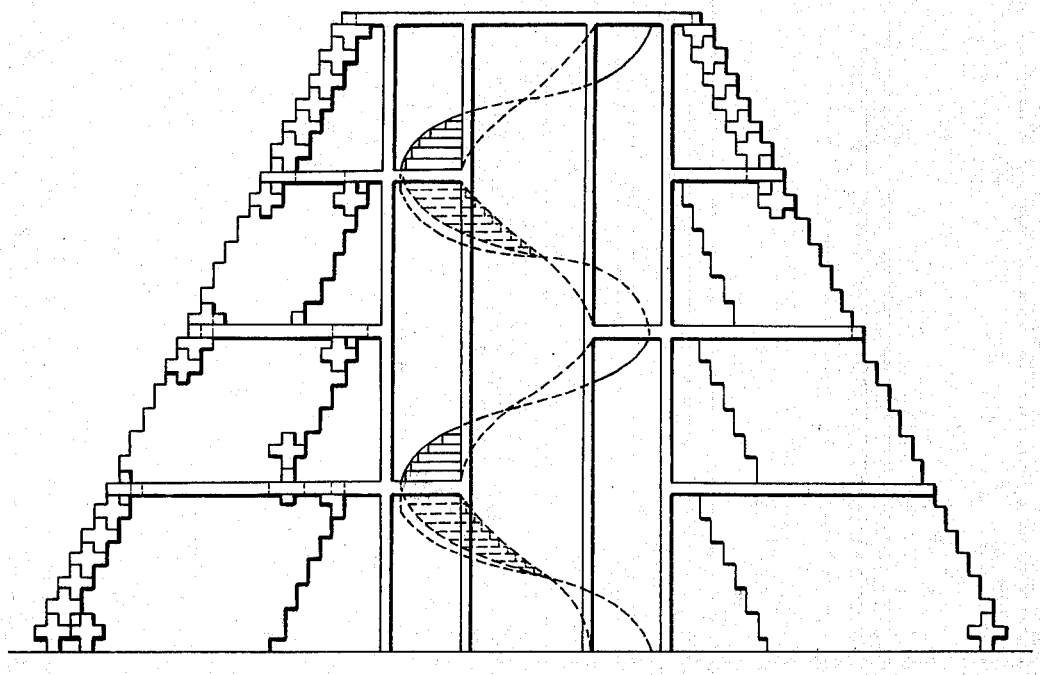
Figure 8B:
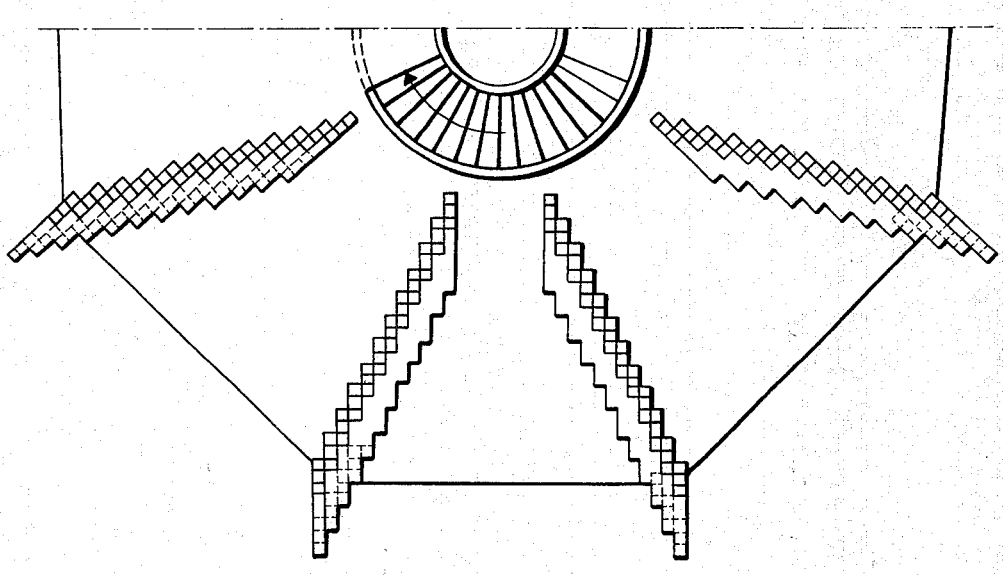

FIG. 8*a* shows the section of the multiplestage space to be built up of urn holding elements according to FIG. 6*a*, while FIG. 8*b* is the plan view in section of the space according to FIG. 8*a*.

As it is to be seen in FIGS. 1 and 2, the urn holding elements are developed so that a projection on one element fits in the corresponding recess of the other element. The built-up space of a barrel vault thus is actually self-retaining, but the elements shall be duly fastened to each other by means of binder or adhesive. For this purpose, plastic adhesives can be used, whereas the urn holding elements can be made — practically in mass production — of ceramic or other suitable material, in tasteful and attractive form. Certain elements can be developed in such a manner that instead of urn holding, lighting orifices can be provided for or lighting fittings can be arranged therein for illuminating the interior space, as it is to be seen in FIG. 3*a*, where the light beams are indicated schematically by arrows. The shape of the urn holding elements may be such as to render possible the building of helical or annular interior spaces, while between the single units footpaths, lawn areas, parking places, areas covered with trees and bushes can be provided.

With the solution shown in FIGS. 6, 7, and 8, monuments can be provided. Here, the elements can be fastened e.g. by screwing. With each solution, the fundamental advantage consists in that the complete interior space need not be built up at once, but it can be expanded as required.

Remarkably numerous variants of urn holding elements deviating from the disclosed embodiments can be provided, of course, and correspondingly various interior spaces can be provided as desired, a common characteristic of all these being that they consist of building elements, in at least a part of which — expediently, however, in the majority of building elements — urn holding recesses are provided.

What we claim is:

1. A system for sepulchral urn burial, comprising at least one building comprised of a plurality of building elements, said elements being ceramic blocks having rectangular front and rear faces and in two adjacent edges of each block two recesses that communicate with each other and on the other two adjacent edges of each block integral projections that are complementary to and interfit within said recesses of three immediately adjacent said blocks, an adhesive binder interconnecting said blocks, and at least one sepulchral urn disposed in a recess in said front face of at least some of said blocks, said urns being accessible from one side of said elements.

* * * * *